United States Patent [19]
Erdtmann et al.
[11] 4,201,625
[45] May 6, 1980

[54] PROCESS FOR PRODUCING $^{52}$MANGANESE

[75] Inventors: Gerhard Erdtmann, Jülich; Chaturvedula Sastri, Berlin; Gottfried Küppers, Heinsbert-Oberbruch; Hermann Petri, Jülich, all of Fed. Rep. of Germany

[73] Assignee: Kernforschungsanlage Jülich Gesellschaft mit beschränkter Haftung, Jülich, Fed. Rep. of Germany

[21] Appl. No.: 962,139

[22] Filed: Nov. 20, 1978

[30] Foreign Application Priority Data

Nov. 23, 1977 [DE] Fed. Rep. of Germany ..... 2752165
Oct. 19, 1978 [DE] Fed. Rep. of Germany ..... 2845457

[51] Int. Cl.$^2$ ..... G21G 1/10
[52] U.S. Cl. ..... 176/11; 176/16
[58] Field of Search ..... 176/11-16

[56] References Cited

PUBLICATIONS

"Kunstliche Radioaktive Isotope in Physiologie, Diagnostik und Therapie", by Schwiegls & Turba, 1961, p. 259.
"Interne Tumortherapie mit Kunstlich Radioaktiven Isotopen", Muller, p. 798.
"Blutkrankheiten", Heilmeyer & Keiderling, pp. 834, 862.
"Kernenergie", vol. 5, Issue 12/62, pp. 853-859.
"Radioisotope Production & Quality Control", IAEA, Vienna, 1971 (ST1/DOC-10/128), pp. 808-812.
"Atomwirtschaft", 1/78, pp. 36-39, article by Harder et al.

*Primary Examiner*—Harvey E. Behrend
*Attorney, Agent, or Firm*—Frishauf, Holtz, Goodman & Woodward

[57] ABSTRACT

A target containing vanadium, either of natural isotopic constitution or enriched either with respect to $^{50}$vanadium or $^{51}$vanadium, is bombarded with $^{3}$helium of an energy of about 14 MeV producing $^{52}$manganese by nuclear reaction from both of these isotopes of vanadium. After a waiting period for the disappearance of short-lived intermediates, the target foil is dissolved in acid and the $^{52}$manganese is extracted with a solution of a hydroxychinolin in chloroform. The oxinate complex of $^{52}$manganese thus extracted can be used directly as a source of $^{52}$manganese in the preparation of compositions for radiochemical or radiopharaceutical purposes.

6 Claims, No Drawings

PROCESS FOR PRODUCING $^{52}$MANGANESE

The present invention concerns a process for producing $^{52}$manganese by a nuclear reaction in which a target having a metal atom content is bombarded with accelerated ions of small mass, after which the $^{52}$manganese formed from the metal atoms by nuclear reaction is isolated by means of a chemical separation process.

$^{52}$Manganese is of interest in the field, along others, of nuclear medicine; for example, for the diagnosis and/or therapy of blood diseases.

According to the known process of production (*Radioisotope Production and Quality Control,* IAEA, Vienna, 1971, Technical Report No. 128, p. 805), the $^{52}$manganese isotope is produced by bombarding chromium or iron with protons or deuterons. In this process, along with the desired $^{52}$manganese, the isotope $^{54}$manganese is also produced. $^{54}$Manganese is undesired, however, because it has a substantially longer half-life (312 days) than $^{52}$manganese (5.7 days), so that on account of the higher radiation exposure of the patient, limits are imposed on its use in nuclear medicine. $^{54}$Manganese can be separated out of an isotope mixture with $^{52}$manganese only with great difficulty and at great expense.

THE PRESENT INVENTION

It is an object of the present invention to provide a process by which $^{52}$manganese can be obtained in a relatively simple manner.

Briefly, a target containing vanadium is bombarded with $^{3}$helium ions and the $^{52}$manganese produced thereby is isolated chemically from among the target materials.

$^{52}$Manganese is formed from vanadium by $^{3}$helium bombardment by the following nuclear reactions:

$$^{50}V(^{3}He,n)^{52}Mn;\ Q=8{,}3\ MeV$$

$$^{51}V(^{3}He,2n)^{52}Mn;\ Q=-2{,}7\ MeV$$

$^{50}$V and $^{51}$V are contained in natural vanadium to the extent respectively of 0.25% and 99.75%. According to a particularly simple manner of carrying out the process of the invention, the target is simply constituted by a vanadium foil, which is then dissolved in acid after the $^{3}$He bombardment. The $^{52}$manganese is then chemically isolated from the solution.

The nuclear reaction of vanadium with $^{3}$helium ions suited for the production of $^{52}$manganese takes place also in the presence of other substances, so that it is also possible to utilize a target in which vanadium is present in an alloy or in a chemical compound, in which case, the accompanying chemical elements should not produce any disturbing or interfering reactions upon $^{3}$helium bombardment. Since $^{52}$manganese is produced from both $^{50}$V and $^{51}$V upon $^{3}$He bombardment, it is possible to use for the production of $^{52}$manganese according to the invention, a vanadium-containing target of which the vanadium has an isotope distribution that varies from the natural isotope distribution in vanadium.

Measurements of the radioactivity immediately after the $^{3}$He irradiation show the presence of short-living nuclides as $^{52m}$Mn, $^{51}$Mn, $^{49}$Cr and $^{52}$V. The decay of $^{51}$Mn with a half-life of 46 minutes yields the likewise radioactive $^{51}$Cr having a half-life of 27.7 days which should be absent in the prepared $^{52}$Mn. Therefore a delay period for the substantial decay of $^{51}$Mn is preferred between the irradiation of the target and the chemical separation of manganese. After such a delay the high purity of the $^{52}$Mn can be perceived. $^{3}$He ions having an energy of about 14 MeV are preferred for the $^{3}$He bombardment of the target.

ILLUSTRATIVE EXAMPLE

A foil of vanadium measuring 20 by 20 mm in size and 0.25 mm thick was bombarded in a cyclotron with $^{3}$helium ions of 14 MeV energy at an intensity of 500 nA for 60 minutes with water cooling. Ten hours after the end of the irradiation, the vanadium foil was dissolved in 5 ml of 40% nitric acid. The solution was treated with 20 ml of a saturated potassium iodate solution and boiled until the color changed from green to yellow. The solution was allowed to cool, was brought to a pH value of 10 with sodium hydroxide solution and was immediately extracted with 40 ml of a 0.1 m solution of 8-hydroxychinolin in chloroform. The organic phase was washed with 20 ml of an aqueous solution set at pH=10 with sodium hydroxide.

The organic phase contained only the desired $^{52}$manganese, while all the other radionuclides produced by the nuclear reaction remained in the aqueous phase.

The yield of $^{52}$manganese amounted to 6 $\mu$Ci per $\mu$Ah($6.2\cdot10^{7}s^{-1}/C$).

The chemical yield of the separation process described was from about 50 to 60% at 24 hours after the end of irridation. the radiochemical purity check carried out with a $\gamma$ spectrometer showed less than 0.1% $^{54}$manganese and 0.1% $^{51}$chromium, referred to the quantity of $^{52}$manganese produced.

Contamination with $^{54}$manganese occurs in the nuclear reaction with the chromium contained in very small quantities in the target material. It amounts (at the start) to about $5\times10^{-6}$% per ppm of chromium. When a vanadium foil of technical quality with about 500 ppm of chromium is used, $^{52}$manganese is, accordingly, obtained with about $2.5\times10^{-3}$% of $^{54}$manganese impurity; whereas, from a very pure vanadium with 2 ppm chromium content, a product is produced that contains only $10^{-5}$% of $^{54}$manganese.

The $^{52}$manganese dissolved in chloroform as an oxinate complex is useful and easily available as a starting material for the preparation of radiochemical or radiopharmaceutical compositions. The manganese oxinate complex can, of course, be readily converted to provide some other manganese compound for uses of $^{52}$Mn in which the chloroform solvent medium is undesirable.

Although the invention has been illustrated with reference to a particular illustrative example, it will be understood that variations and modifications of the illustrated example are possible within the inventive concept.

We claim:

1. A process for producing $^{52}$Mn by nuclear reaction, comprising the steps of:

bombarding a vanadium-containing target with accelerated $^{3}$helium ions, and isolating the $^{52}$manganese thereby produced from the other target constituents after the bombardment by means of a chemical separation procedure.

2. A process as defined in claim 1 in which said vanadium-containing target is a metal foil of a substance selected from the group consisting of vanadium and vanadium alloys.

3. A process as defined in claim 1 in which a waiting period for the substantial decay of $^{52}$manganese is provided between the irridation bombardment of the target and the chemical isolation of the manganese produced.

4. A process as defined in any of the preceding claims in which in the step of bombarding the target, said accelerated $^{3}$helium ions are accelerated to an energy of about 14 MeV.

5. A process as defined in any of claims 1–3 in which said vanadium-containing target has a vanadium content consisting of $^{51}$V-enriched vanadium.

6. A process as defined in any of claims 1–3, in which said chemical separation procedure comprises extraction by a solution, in an organic liquid of a manganese-complexing agent.

* * * * *